United States Patent [19]

Tsuji et al.

[11] Patent Number: 4,774,545

[45] Date of Patent: Sep. 27, 1988

[54] CUT PAPER ELECTROPHOTOGRAPHIC PRINTERS WITH CONTINUOUS PAPER FEED MECHANISMS

[75] Inventors: Yasuyuki Tsuji; Akira Terakado, both of Ibaraki, Japan

[73] Assignee: Hitachi Koki Company, Limited, Tokyo, Japan

[21] Appl. No.: 53,777

[22] Filed: May 26, 1987

[30] Foreign Application Priority Data

May 23, 1986 [JP] Japan ..... 61-119435

[51] Int. Cl.[4] ..... G03G 15/00

[52] U.S. Cl. ..... 355/14 SH; 271/9; 271/286; 271/291; 271/301; 355/3 SH; 355/23; 355/24

[58] Field of Search ..... 355/23, 24, 3 SH, 14 SH, 355/25, 3 R; 271/9, 285, 286, 291, 301

[56] References Cited

U.S. PATENT DOCUMENTS

| | | | |
|---|---|---|---|
| 4,456,236 | 6/1984 | Buddenbeck | 355/14 SH X |
| 4,568,169 | 2/1986 | Wada et al. | 355/3 SH |
| 4,568,172 | 2/1986 | Acquaviva | 355/3 SH X |
| 4,597,660 | 7/1986 | Leng et al. | 355/3 SH |
| 4,650,313 | 5/1987 | Koike | 355/3 SH |

FOREIGN PATENT DOCUMENTS

| | | | |
|---|---|---|---|
| 0142360 | 8/1983 | Japan | 355/14 SH |

*Primary Examiner*—Arthur T. Grimley
*Assistant Examiner*—John G. Smith
*Attorney, Agent, or Firm*—Sughrue, Mion, Zinn, Macpeak, and Seas

[57] ABSTRACT

Cut paper electrophotographic printers with continuous paper feed mechanisms including a pickup roll, a photosensitive drum, a charging unit, an optical unit, a host controller, a developing unit, a transfer unit and fixing rolls. Further included are first and second branch passages for providing alternate feeding paths to continuously feed cut paper sheets to the photosensitive drum.

9 Claims, 2 Drawing Sheets

CUT PAPER ELECTROPHOTOGRAPHIC PRINTERS WITH CONTINUOUS PAPER FEED MECHANISMS

BACKGROUND OF THE INVENTION

1. Field of the Invention

The present invention relates to electrophotographic printers and, more particularly, to so-called "cut paper electrophotographic printers" for printing sheets of cut paper with an electrophotographic process, each printer having an improved paper feed mechanism.

2. Background of the Invention

Before entering into the detailed description of the present invention, an electrophotographic printer according to the prior art will be described with reference to the schematic diagram of FIG. 1.

A photosensitive drum 1, a pair of feed rolls 2 and a pair of fixing rolls 3 rotate at a constant speed at all times. For printing operations, the photosensitive drum 1 is uniformly charged by a charging unit 6. Printing signals are transmitted from a host control circuit 11 to an optical unit 7 so that a laser beam 8 carrying the printing signal exposes the surface of the photosensitive drum 1. The portions exposed by the laser beam 8 are developed with toner by a developing unit 9. This toner is transferred to a sheet of paper 10 by a transfer unit 12 and is fixed on the paper 10 while passing through the fixing rolls 3.

The relation between the paper 10 and the laser beam 8 will be described in detail in the following in connection with the series process described above. A pair of timing rolls 5 are provided for arranging the top margin of the paper 10, i.e., the distance from the top edge to the first line. The paper 10, picked up by a pickup roll 4, is moved forward by the feed rolls 2 to come into abutment against the timing rolls 5. At this time these timing rolls 5 are held stopped. When the first line on the photosensitive drum 1 exposed by the laser beam 8 reaches a predetermined position, the timing rolls 5 are driven to send the paper 10 toward the transfer unit 12. Since the upper end and first line of the paper 10 have their phases arranged in this way, their distance is arranged for each sheet of paper 10.

Here arises a problem in that the temporary halt of the paper 10 results in a gap A (Note: Reference numeral "A" and other alphabetical reference numerals will be underlined throughout the specification to distinguish the reference numerals from word text) between the sheets of paper 10 as they cross the photosensitive drum 1, as is better seen from FIG. 2. This gap A, thus required, is different depending upon the printing rate of the printer, but is about 100 mm for a printer having a printing rate of about 50 sheets of A4 size (i.e., 210 mm×297 mm or 8.27 in.×11.69 in.) paper per minute. This makes it necessary to increase the developing/transferring (i.e., processing) rate to an extent corresponding to the gap A. Specifically, the processing rate of the printer having the printing rate of about 50 sheets of A4 size (i.e., 210 mm×297 mm or 8.27 in.×11.69 in.) paper per minute is calculated as follows:

(210 mm (per width of A4 paper)×50 (sheets/-minute)+100 mm (width per Gap A)×50 (Gaps/-minute)/60 sec (i.e. 60 sec./minute)=258 mm/sec.

If the gap A could be reduced to zero, the processing rate at this time would be calculated as follows and shortened to a factor of about 1/1.5:

(210 mm (per width of A4 paper)×50 (sheets/-minute)/60 sec (i.e., 60 sec./minute)=175 mm/sec.

On the contrary, the electrophotographic printer using a roll of continuous paper does not require the gap A so that it can enjoy a relatively higher printing rate. On the other hand, the transferring, developing and fixing techniques become more difficult for the higher processing rate. If the gap A can be reduced, it is accordingly expected that a cut paper electrophotographic printer having a higher printing rate can be produced.

SUMMARY OF THE INVENTION

It is, therefore, an object of the present invention to eliminate the aforementioned drawbacks of the prior art and to provide an electrophotographic printer which is enabled to have a higher printing rate (i.e., number of sheets per minute) for a common processing rate by reducing the gap A substantially to zero.

According to the present invention, there is provided a cut paper electrophotographic printer for printing sheets of cut paper continuously with an electrophotographic process. The printer includes a pickup roll made rotatable for picking up the cut paper sheets one by one. A photosensitive drum is made rotatable for temporarily retaining thereon printing optical information when it is exposed to the laser beam bearing the optical information. A charging unit uniformly charges the photosensitive drum before the exposure. An optical unit emits the laser beam in response to printing signals. A host control circuit synchronized with the photosensitive drum emits the printing signals. A developing unit develops the exposed portion of the photosensitive drum with toner. A transfer unit transfers the toner from the photosensitive drum to each of the cut paper sheets. A pair of fixing rolls made rotatable at the same circumferential speed as that of the photosensitive drum fix the toner on each cut paper sheet.

The improvement of the invention comprises means for feeding the cut paper sheets one by one from the pickup roll onto the photosensitive drum. The feeding means includes two branch passages for alternately feeding the cut paper sheets such that each has a common margin between the top edge and the first line thereof. Passage switching means alternately switch the two branch passages to feed out one sheet to one of the branch passages and then a next sheet to the other to thereby reduce the gap between the two adjacent sheets substantially to zero.

The present invention has been conceived by noting that the printing rate of the cut paper electrophotographic printer is highly influenced by the gap A between the adjacent sheets of paper and accordingly provides redesigned timing rolls.

BRIEF DESCRIPTION OF THE DRAWINGS

Other objects, features and advantages of the present invention will become apparent from the following description taken with reference to the accompanying drawings, in which.

DETAILED DESCRIPTION OF THE PREFERRED EMBODIMENTS

Figure 1:
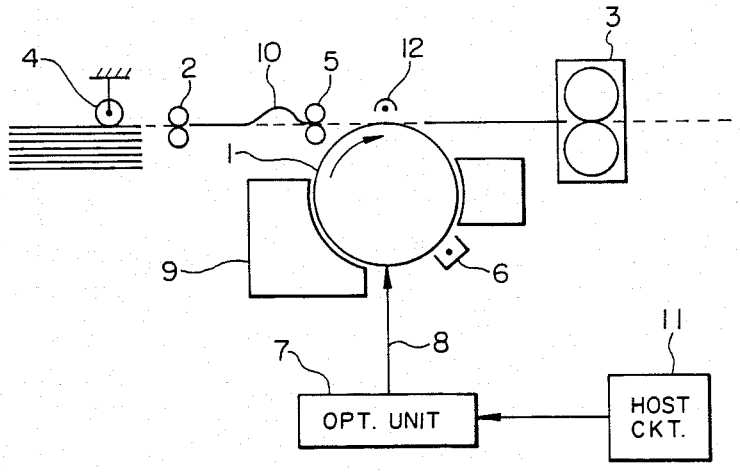
FIG. 1 PRIOR ART
FIG. 1 shows the electrophotographic printer according to the prior art.
Figure 3:
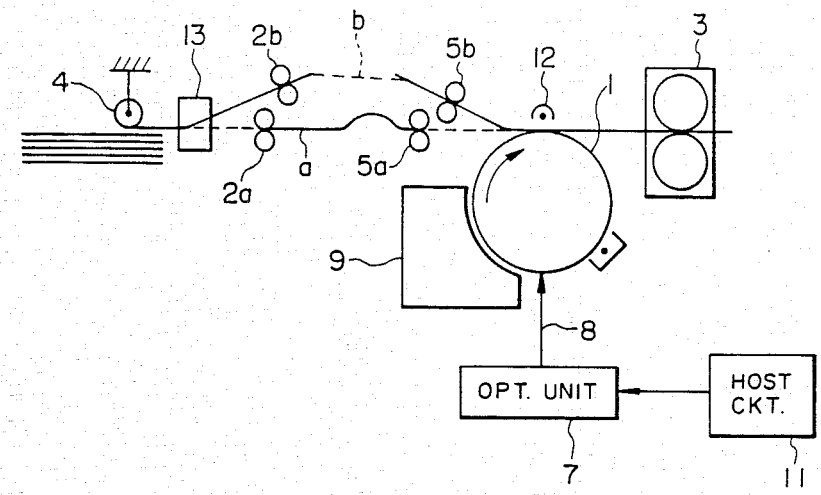
FIG. 3 is similar to FIG. 1 but is a schematic diagram showing an embodiment of the electrophotographic printer according to the present invention.

FIG. 3 shows a specific embodiment of the present invention, which is different from the prior art of FIG. 1 in the following points. The paper passage extending from the pickup roll 4 to the photosensitive drum 1 is branched and is equipped with two pairs of feed rolls 2*a* and 2*b* and two pairs of timing rolls 5*a* and 5*b*. A passage switching mechanism 13 is interposed between the pickup roll 4 and the feed rolls 2*a* and 2*b*. In the structure of FIG. 3, the pickup roll 4 and the feed rolls 2*a* and 2*b* are rotated at a circumferential speed one and one-half to two times as high as that of the photosensitive drum 1.

Figure 2:
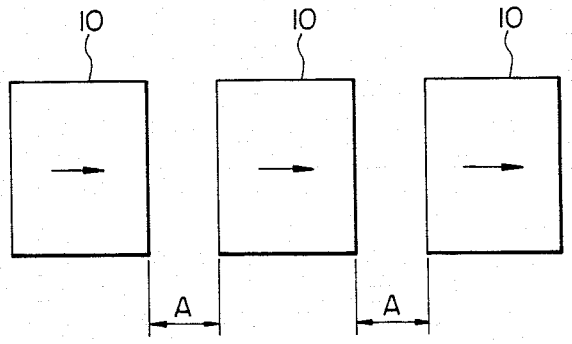
FIG. 2 PRIOR ART
FIG. 2 is a schematic view showing the principle of the flow of paper sheets in the prior art.

The paper feed for the printing operations is conducted in the following manner. The first sheet is fed out to a passage a, and the passage switching mechanism 13 is then actuated to feed out the second sheet to a passage b. When the first sheet comes into abutment against the timing rolls 5*a*, these rolls 5*a* are driven at the same circumferential speed as that of the photosensitive roll 1 in synchronism with the laser beam 8 so that the first sheet is fed out to the transfer unit 12. At the instant when the first sheet has just passed through the first timing rolls 5*a*, the second sheet has already abutted against the other timing rolls 5*b*. At this instant, these other timing rolls 5*b* are driven to feed out the second sheet subsequent to the first sheet. Thus, the gap A of FIG. 2 can be reduced to zero by switching the passage a and b alternately for every other sheet.

Figure 4:
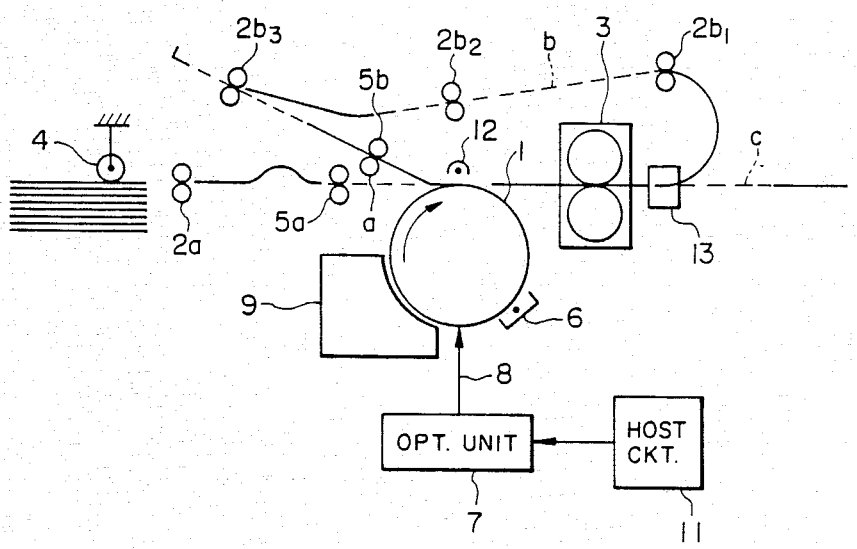
FIG. 4 is a schematic view showing another embodiment in which the present invention is applied to a double-side (i.e., duplex) printer.

FIG. 4 shows another embodiment in which the structure of the present invention is applied to a double-sided (i.e., duplex) electrophotographic printer. A double-sided (i.e., duplex) printer is one which prints on both sides of a sheet. In FIG. 4, the passage b provides for the turning back or side reversal of a paper sheet already having its one surface transferred and fixed. In the return passage b, moreover, there are arranged three pairs of feed rolls $2b_1$, $2b_2$ and $2b_3$ which also have a circumferential speed 1.5 to 2 times as high as that of the photosensitive drum 1. The printing operations are conducted in the following sequence:

(1) A first page of information is printed on the first side of a first sheet and the sheet is then fed to the return passage b by actuating the passage switching mechanism 13;

(2) With a gap of about one sheet, a third page of information is printed on the first side of a second sheet and is fed to the return passage b;

(3) With another gap of about one sheet, a fifth page of information is printed on the first side of a third sheet and the sheet is then fed to the return passage b.

(4) By the time printing of the fifth page has finished, the first sheet is turned back at a reversing section by the feed rolls $2b_3$ and is thereafter advanced to the timing rolls 5*b*, where it is halted, its other or second unprinted surface directed downward in FIG. 4. Thereafter, the timing rolls 5*b* are driven to print the back or second side of the first sheet with a second page of information. The first sheet bearing the first and second pages on a first side and a second side is then fed to a discharge passage c by driving the passage switching mechanism 13 until the sheet is discharged to the outside of the printer;

(5) Immediately after the second page has been printed, a fourth sheet has a seventh page of information is printed on the first side thereon by driving the timing rolls 5*a*. This fourth sheet is fed to the return passage b by actuating the passage switching mechanism 13; and then (6) A fourth page of information is printed on the back or second side of the second sheet, which had already been printed with the third page of information on a first side, by driving the timing rolls 5*b*. The second sheet bearing the third and fourth pages on first and second sides, respectively, is fed to the discharge passage c by driving the passage switching mechanism 13 until the sheet is discharged to the outside of the printer.

By driving the timing rolls 5*a* and 5*b* alternately to sequentially execute the above-specified steps (1) to (6), individual sheets of paper can be printed alternately on their front and back surfaces continuously without any interval between the printing of each front and back surface of sequential sheets of paper.

Despite this fact, however, the gap A (of FIG. 2) is required between the adjacent sheets (as in the prior art) when only one side is to be printed with the structure of FIG. 4.

In contrast, if each sheet is to have its two sides printed in the prior art using only one pair of timing rolls, the sheet residing in the passage b would have again been guided into the passage a and have been driven by the single pair of timing rolls for each of two sides so that the gap A would have been encountered twice.

According to the present invention, there is no need for establishing the gap A (of FIG. 2) between the adjacent sheets. As a result, the processing rate can be reduced from [about 1/1.5 as high as] that of the prior art assuming that [even if] the number of sheets to be processed per unit time is common. In viewing this advantage from another perspective, the number of sheets to be processed per unit time can be increased to about 1.5 times as high as that of the prior art for a common processing rate.

In the present invention as well as the prior art, it should be noted that the handling of each sheet has to include a "settling time to allow each sheet to become settled i.e., move to a position where the sheet is abutted against the timing rolls. As another advantage of the present invention, this settling time period can be elongated as an auxiliary effect of the present invention. For example, the settling time periods for the printer having the printing rate of 50 sheets per minute are calculated as follows;

According to the prior art;

210 mm (per width of A4 paper)÷258 mm/sec (processing rate)=0.8/sec (settling time per sheet)

According to the present invention;

210 mm (per width of A4 paper)÷175 mm/sec (processing rate)=1.2 sec (settling time per sheet). Thus, a settling time period which is higher than that of the prior art can be attained according to the present invention.

What is claimed is:

1. A cut paper printer for printing sheets of cut paper continuously, comprising:

pickup roll means being rotatable for picking up cut paper sheets one by one;

photosensitive drum means being rotatable for exposure to a light beam containing an image signal;

charging unit means for uniformly charging said photosensitive drum means before said exposure;

developing unit means for developing an exposed portion of said photosensitive drum means with toner;

transfer unit means for transferring toner from said photosensitive drum means to a respective one of said cut paper sheets;

fixing roll means being rotatable at the same circumferential speed as that of said photosensitive drum means for fixing the toner on each said cut paper sheet; and feeding means for feeding said cut paper sheets one by one from said pickup roll means onto said photosensitive drum means, said feeding means including;

first and second branch passage means for providing first and second passages, respectively, each of said first and second passages representing an alternate feeding path to feed said cut paper sheets to said photosensitive drum means; and passage switching means for alternately directing said cut paper sheets from said pickup roll means into one of said first and second branch passage means.

2. A cut paper electrophotographic printer as recited in claim 1, further comprising:

optical unit means for emitting said light beam in response to printing signals, said light beam containing said image signal; and host control unit means synchronized with said photosensitive drum means for emitting said printing signals.

3. A cut paper printer according to claim 1, wherein each of said first and second branch passages includes:

feed roll means disposed downstream of said passage switching means for feeding each of said cut paper sheets when the corresponding one of said first and second branch passage means is selected by said passage switching means; and timing roll means being rotatable at the same circumferential speed as that of said photosensitive drum means, said timing roll means being rotated at predetermined times to bring said cut paper sheets into contact with said photosensitive drum means in synchronism with an exposed portion.

4. A cut paper electrophotographic printer as recited in claim 3, further comprising:

optical unit means for emitting said light beam in response to printing signals, said light beam containing an image signal; and host control unit means synchronized with said photosensitive drum means for emitting said printing signals.

5. A cut paper electrophotographic printer according to claim 1, wherein said pickup roll means and said feed roll means are rotated at a circumferential speed 1.5 to 2 times as high as that of said photosensitive drum means.

6. A cut paper electrophotographic printer for printing two sides of sheets of cut paper, comprising:

pickup roll means being rotatable for picking up cut paper sheets one by one;

photosensitive drum means being rotatable for exposure to a light beam containing an image signal;

charging unit means for uniformly charging said photosensitive drum means before an exposure;

optical unit means for emitting said light beam in response to printing signals, said printing signals being arranged in pages;

host unit means synchronized with said photosensitive drum means for emitting said printing signals;

developing unit means for developing an exposed portion of said photosensitive drum means with toner;

transfer unit means for transferring the toner from said photosensitive drum means to at least one side of a respective one of said cut paper sheets;

fixing roll means being rotatable at the same circumferential speed as that of said photosensitive drum means for fixing the toner on said cut paper sheets; and return passage means for feeding back said cut paper sheets having one side printed from said fixing roll means;

discharge passage means for feeding to the outside of said printer said cut paper sheets having two sides printed; and passage switching means for alternately directing said cut paper sheets from said fixing rolls into one of said return passage means and said discharge passage means.

7. A cut paper electrophotographic printer according to claim 6, further comprising delivering means for delivery of said cut paper sheets one by one from said pickup roll means onto said photosensitive drum means, said delivering means including a delivery passage having:

feed roll means disposed downstream of said pickup roll means for feeding each of said cut paper sheets; and timing roll means being rotatable at the same circumferential speed as that of said photosensitive drum means, said timing roll means being rotated at predetermined times to bring said cut paper sheets into contact with said photosensitive drum means in synchronism with an exposed portion.

8. A cut paper electrophotographic printer according to claim 6, wherein said return passage means includes:

first, second and third return roll means being disposed in series downstream of said passage switching means for returning each of said cut paper sheets; and return timing roll means being rotatable at the same circumferential speed as that of said photosensitive drum means, said return timing roll means being rotated at predetermined times to bring said cut paper sheets into contact with said photosensitive drum means in synchronism with said exposed portion.

9. A cut paper electrophotographic printer according to claim 8, wherein said first, second and third return roll means are rotated at a circumferential speed 1.5 to 2 times as high as that of said photosensitive drum means.

* * * * *